US005598943A

United States Patent [19]

Markus

[11] Patent Number: 5,598,943

[45] Date of Patent: Feb. 4, 1997

[54] CONTAINER FOR CARRYING GROCERIES AND OTHER OBJECTS

[76] Inventor: Theodore Markus, 157 Willow Creek Ave., Schenectady, N.Y. 12304

[21] Appl. No.: 105,019

[22] Filed: Aug. 10, 1993

[51] Int. Cl.[6] ..... B65D 90/04

[52] U.S. Cl. ..... 220/410; 220/412; 220/421; 220/467; 220/23.86; 220/212.5; 220/739; 220/740; 220/771; 62/457.1; 62/457.7; 62/463; 62/464; 206/545

[58] Field of Search ..... 220/408, 409, 220/410, 412, 413, 420, 421, 422, 444, 467, 468, 23.83, 23.86, 212.5, 739, 740, 753, 771; 62/459, 463, 464, 457.1, 457.2, 457.5, 457.7; 224/42.42, 42.33; 206/545

[56] References Cited

U.S. PATENT DOCUMENTS

| | | | |
|---|---|---|---|
| 1,688,125 | 10/1928 | Megeath | 62/457.7 |
| 2,571,111 | 10/1951 | Clark | 220/412 X |
| 2,652,698 | 9/1953 | Schlumbohm . | |
| 2,954,891 | 10/1960 | Imber | 220/412 X |
| 2,986,300 | 5/1961 | Parrish . | |
| 3,338,068 | 8/1967 | Piker | 62/464 X |
| 4,085,785 | 4/1978 | Hoot | 220/412 X |
| 4,213,309 | 7/1980 | Pifer . | |
| 4,213,310 | 7/1980 | Buss . | |
| 4,319,629 | 3/1982 | Hotta | 62/457.2 X |
| 4,336,883 | 6/1982 | Krug et al. . | |
| 4,351,165 | 9/1982 | Gottsegen et al. . | |
| 4,893,478 | 1/1990 | Kruck et al. . | |

*Primary Examiner*—Stephen Cronin
*Attorney, Agent, or Firm*—Edward W. Porter

[57] ABSTRACT

A container is provided for holding and carrying objects, including groceries, and for enabling those objects to better maintain their temperature. The container comprises an insulated body having a cavity which opens upward, a movable lid which can fit across the cavity's opening to close it, and a removable, relatively rigid, basket which fits within the cavity. The insulated body and basket has a size to enable two, but not three, standard grocery bags to stand up within the enclosed basket when the lid is shut. The basket has one or more handles which make it easy to remove its contents from the insulated body. The inside surfaces of the insulated body and the basket are tapered, so the basket can be easily withdrawn from the insulated body and so more than one basket can be stacked inside the insulated body. Space is provided between the basket and the insulated body for cooling packs. The basket is spaced from the interior of the insulated body, to enable air cooled by the cooling packs to circulate around the basket and to proved insulation. The bottom of the insulating body contains treads or teeth to prevent it from slipping relative to the surface it is placed upon.

11 Claims, 6 Drawing Sheets

CONTAINER FOR CARRYING GROCERIES AND OTHER OBJECTS

FIELD OF THE INVENTION

The present invention relates to a container for carrying and/or temporarily storing objects including, but not limited to, groceries, chilled beverages, and articles of food.

BACKGROUND OF THE INVENTION

Every day millions of people carry and store objects in their automotive vehicles. Often they merely place such objects, or bags full of such objects, in or on the seats, foot wells, trunk, or, if they have a trunk or pick up, backs of their vehicles. Often such objects tip over or roll around, making the vehicle messy.

This problem is particularly annoying if the objects are groceries. If they fall over, bottles can brake and containers can spill, not only making a mess, but also resulting in the loss of the grocery items involved. If the items are perishable, such as meats or dairy products, placing them in bag does little to insulate them, making it necessary to get them home and into a refrigerator rapidly or else they will spoil. Similarly, chilled drinks will normally loose their coolness rapidly if they are carried in an automobile. Furthermore, it would be desirable to have a means for conveying groceries and other articles which could be used without the need for shopping bags, to conserve the cost and avoid the environmental damage caused by making and disposal of such bags.

Thus, there is a need for a better means for carrying and storing objects, including groceries, in vehicle such as car, trucks, and vans.

SUMMARY OF THE INVENTION

It is an object of the invention to provide a container for carrying bags of groceries and other objects which will tend to prevent those bags from tipping over and spilling.

It is another object of the invention to provide a container for carrying groceries and other objects which is of a size that fits conveniently into the trunks of most automobiles.

It is yet another object of the invention to provide a container for carrying groceries and other objects which will tend to keep cold objects cold, or hot objects hot, while they are being transported.

It is still another object of the invention to provide a container for carrying groceries and other objects which makes it easy to remove the objects being carried from the container.

It is yet another object of the invention to provide a container for carrying groceries and other objects which is relatively compact.

It is still another object of the invention to provide a container for carrying groceries and other objects which will tend not to slip when used in automotive vehicles.

It is yet another object of the invention to provide a container for carrying groceries and other articles which does not require the use of grocery or other shopping bags.

The present invention relates to a container for holding and carrying objects and for enabling objects placed within it to better maintain their temperature. The container comprises an insulated body having a cavity which opens at the top when the container is in an upright position. It further contains a movable lid which can be positions to fit across the cavity's opening so as to close it. A removable basket fits within the cavity. The basket is shaped to fit against the interior surfaces of the insulated body, so the basket encloses a substantial portion of the cavity formed by the insulated body.

In a preferred embodiment, the insulated body and basket are sized to enable two, but not three, standard grocery bags to stand up within basket when it is in the insulated body and the lid is shut. Preferably the basket is sufficiently rigid so it can be used to lift two bags of groceries out of the insulated body without deforming. It is desirable that both the inside surfaces of the insulated body and the basket are tapered so that the basket can be easily withdraw from the insulated body and so that more than one basket can be stacked inside the insulated body.

In a preferred embodiment, space is provided between the basket and the walls of the insulated body and cooling packs are provided in that space. It is also advantageous if means are provided for spacing the walls of the basket from the interior walls of the insulated body, both to enable air cooled by the cooling packs to better circulate around the basket and to proved a space for insulation.

It is also preferred that the bottom exterior surface of the insulating body contains grabbing means designed to decrease the likelihood that the container will slip relative to the surface on which it is placed. In a preferred embodiment this includes either a tread placed on the bottom of the insulated body, a series of teeth which extend down from it to grab into a surface, such as a carpet, on which the container is placed, or both.

DESCRIPTION OF THE DRAWINGS

These and other aspects of the present invention will become more evident upon reading the following description of the preferred embodiment in conjunction with the accompanying drawings, in which.

DETAILED DESCRIPTION OF THE PREFERRED EMBODIMENT

Figure 1:
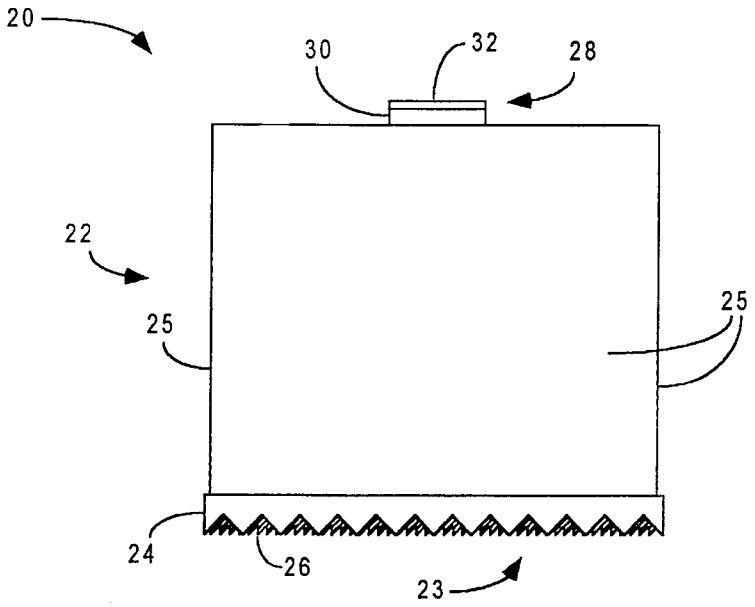
FIG. 1 is a side view of a preferred embodiment of the container of the present invention.

FIG. 1 shows a side view of a preferred embodiment of the container of the present invention. This preferred embodiment has been optimized for carrying objects such as groceries in an automotive vehicle. The container 20 includes a main insulating body 22 formed in the shape of a generally rectangular box having a bottom 23 and four generally vertical sides 25.

Figure 3:
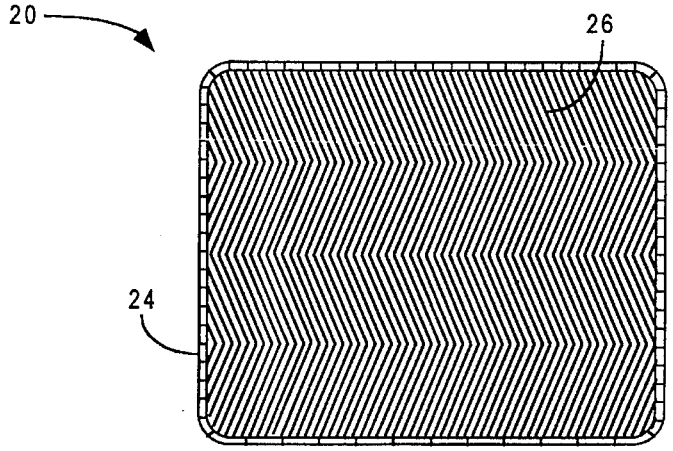
FIG. 3 is a bottom view of the preferred embodiment shown in FIG. 1.

FIG. 3 shows the bottom 23 of the container 20. It is covered with a compressible material, such as a rubber, which has a tread on its bottom surface. Around the edge of the treaded material 26 is a series of teeth 24 which are made out of a more rigid material. Their purpose is to grab into the carpeting which is common in the foot wells, trunks, or rear compartments of most automotive vehicles. These teeth are positioned with their downward pointing ends no lower than the bottom of the tread, so that if the container is placed on a hard flat surface the tread will be able to touch and grip that surface.

Figure 2:
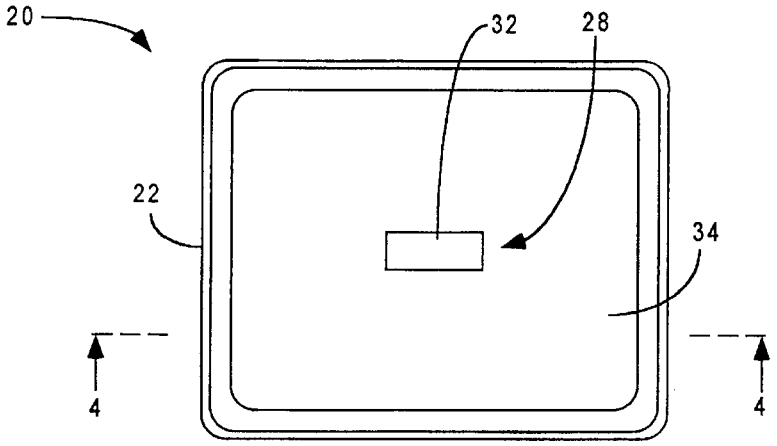
FIG. 2 is a top view of the preferred embodiment shown in FIG. 1.

FIG. 2 shows the top of the container 20. It includes a removable lid 34 which has a handle 28. The handle 28 contains a relatively thin elongated portion 30 topped by a wider elongated portion 32 around which a person using the container can firmly grasp his or her fingers to firmly hold and pull upon the lid.

Figure 4:
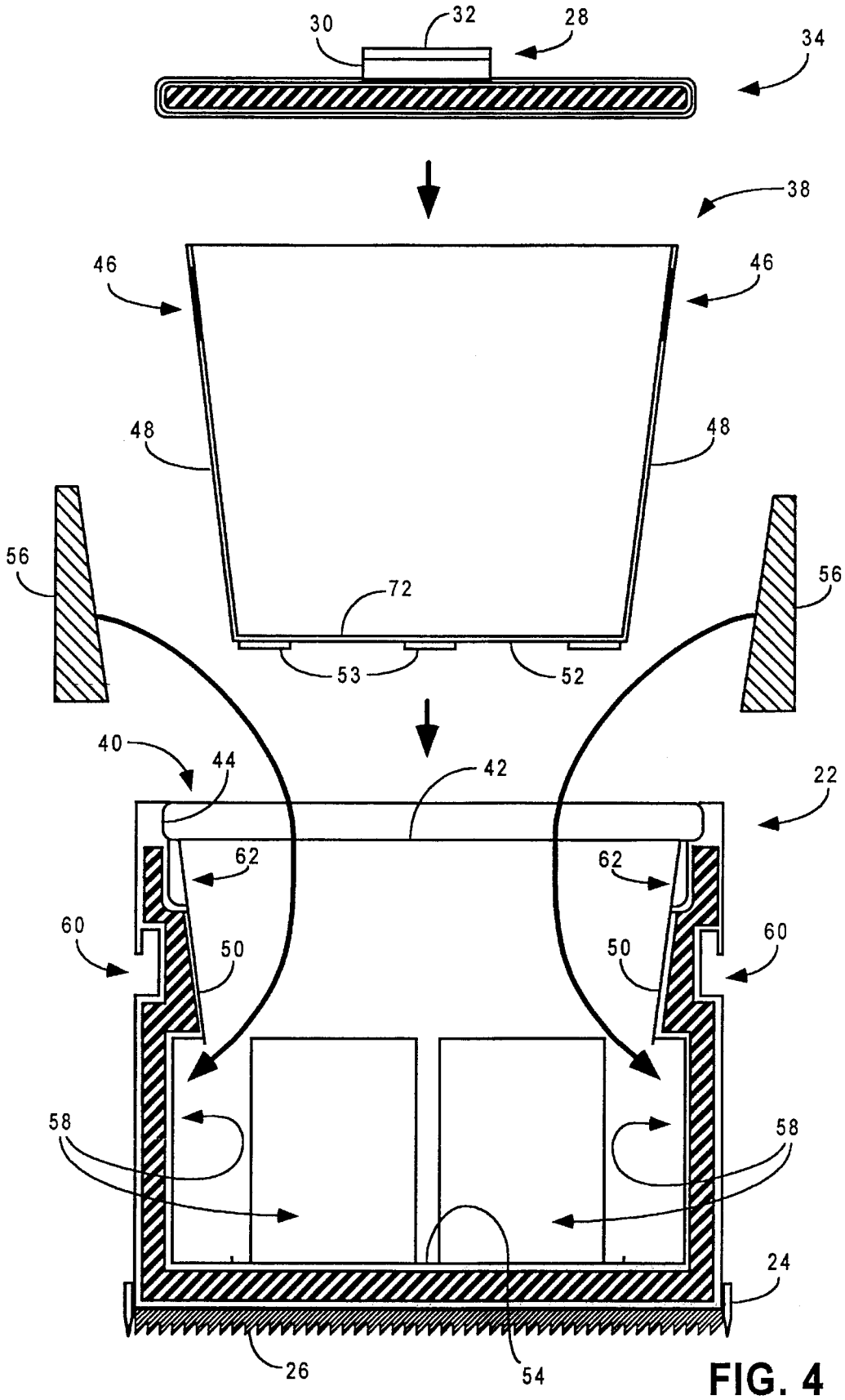
FIG. 4 is an exploded cross-sectional views of the container of the preferred embodiment, taken along the vertical plane indicated by the lines 4—4 in FIG. 2, with its lid, basket, cooling packs, and insulating body shown separately.
Figure 5A:
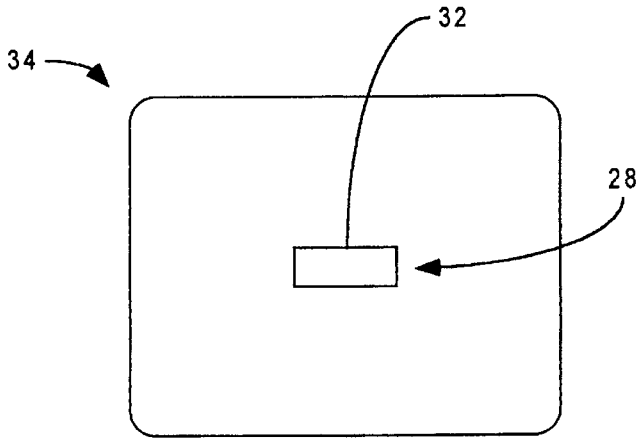
FIGS. 5A, 5B, and 5C are separate top views of the lid, basket, and main insulating body, respectively, shown in FIG. 4.
Figure 5B:
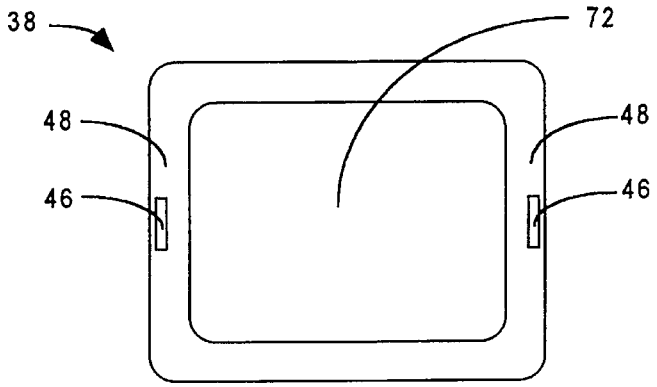
Figure 5C:
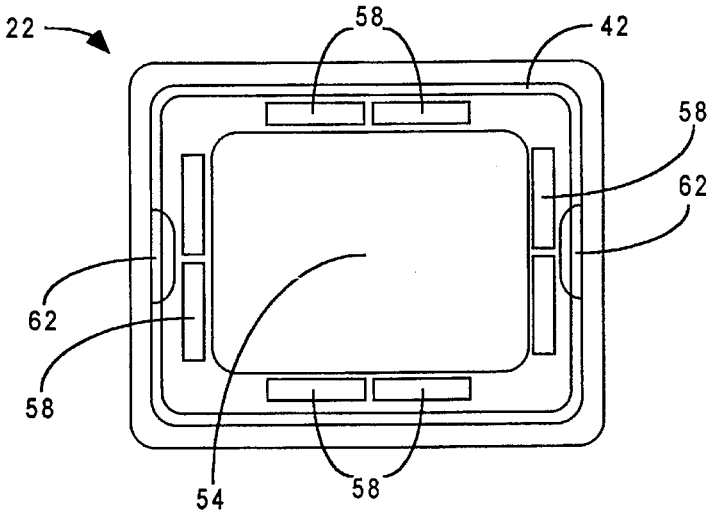

FIG. 4 shows an exploded cross sectional view of the container 20 taken along the vertical plane indicated by the lines 4—4 in FIG. 2. In FIG. 4 the container's removable lid 34, rigid basket 38, and cooler packs 56, are shown removed from its insulating body 22. FIGS. 5A, 5B, and 5C show top views of the separate lid 34, basket 38, and body 22, respectively.

The insulated body 22 and removable lid 34 each have durable, somewhat flexible, plastic surfaces. The space between these durable surfaces are filled with an insulating material, shown in cross hatching in the cross sectional figures. The lid 34 is shaped and sized to be snugly held in place at the top of the opening 40 of the insulated body 22 of the container. This opening 40 has a shelf 42 around its edge which supports the lid 34 and has edges 44 which fit tightly against the lid, making a relatively tight, insulating, seal when the lid is properly placed against the shelf 42. In alternate embodiments of the invention locking mechanisms, or a combination of hinging and locking mechanisms, are used to hold the lid securely in place.

The basket 38 has two handles 46 formed by openings in two of its opposed vertical sides 48. The basket is made of sufficiently thick plastic, or of a combination of such plastic and ribbing, so that it will not be noticeably deformed when held by its two handles 46 and a weight equal to that of two relatively heavy bags of groceries is placed within it. In the preferred embodiment, the vertical sides 48 of the basket 38 are tapered inward towards the bottom of the basket and the internal generally vertical surfaces 50 of the insulated body are also tapered inward at a similar angle toward the insulated body's bottom interior surface 54. This is done to make it easier for the basket to be stacked and to be inserted and withdrawn from the insulated body. The bottom surface 52 of the basket has plastic protrusions 53 which are designed to ensure that the major portion of the basket's bottom surface is spaced up from the interior bottom surface 54 of the insulated body when the basket rests inside that body. This provides an air space for adding additional insulation to the basket. It also provides room for cool air from cooler packs 56 to circulate under the basket. In other embodiments of the inventions means are used to space the basket's side walls, as well as its bottom wall, from the interior surface of the insulated body so as to improve the circulation of cold air from the cooling packs.

The function of the basket is to make it easier to lift groceries and other article out of the container and to carry them. The basket makes it possible to either carry groceries and other articles which are contained within bags, or to carry such groceries or articles directly, without the need for such bags. This ability to carry articles without bags can save the cost of, and prevent the environmental damage caused by, throw-away grocery bags. The removable basket also provides an extra container for holding article which can be used separately from, and in addition to, the container formed by the insulted body. It also protect the interior surfaces of the insulated body and tends to make the container easier to clean, since it can be easily removed for cleaning.

The cooler packs 56 are plastic containers which can be filled with water or other liquid which can be frozen, enabling the cooler packs to absorb heat. The generally vertical interior side walls 50 of the insulated body 22 have indentations 58 which are sized to hold the cooler packs in place between the basket and the insulated walls of the insulated body 22.

The insulated body 22 of the container has openings 60 which form handles for carrying the container. It also has indentations 62 in the shelf 42 upon which the lid 34 rests and in the insulated body's interior side walls 50. These indentations 62 make it easy for a person to grab the handles 46 of the basket when that basket is resting on the bottom interior surface 54 of the insulated body.

Figure 6:
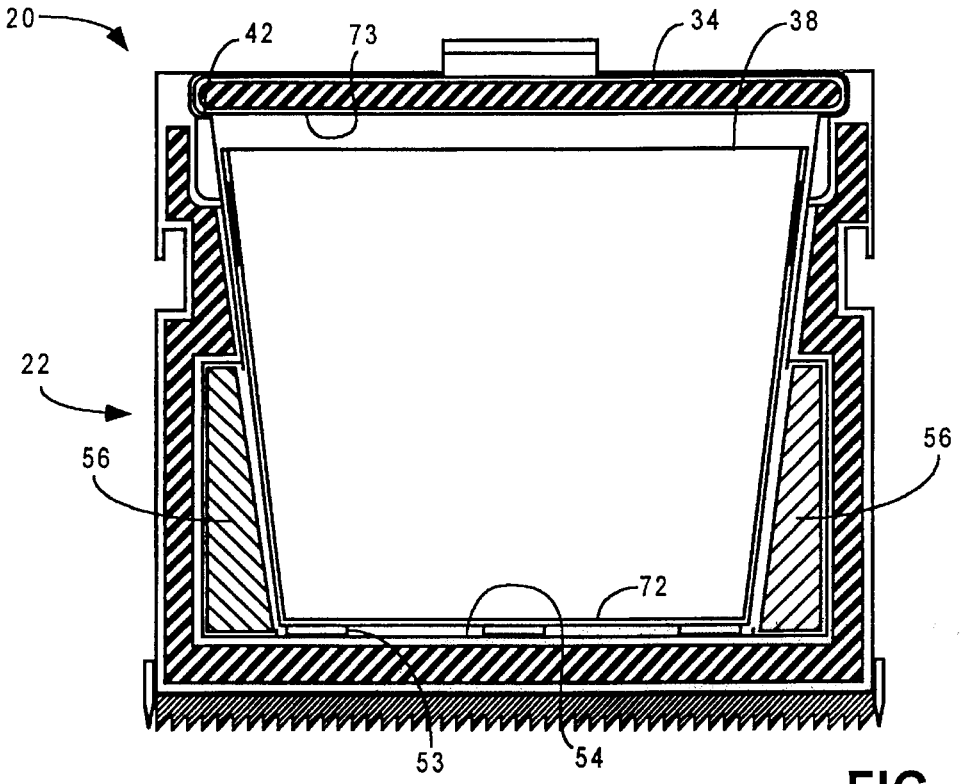
FIG. 6 is a cross sectional view of the preferred embodiment taken along vertical plane indicated by the lines 4—4 shown in FIG. 2.

FIG. 6 shows a cross section of the container 20 taken along the same vertical plane used in FIG. 4, when the cooler packs 56 have been placed into the indentations 58, the basket 38 is resting inside the container's insulated body, and the lid 34 is placed against the self 42 so as to close the insulated body's opening 40.

Figure 7:
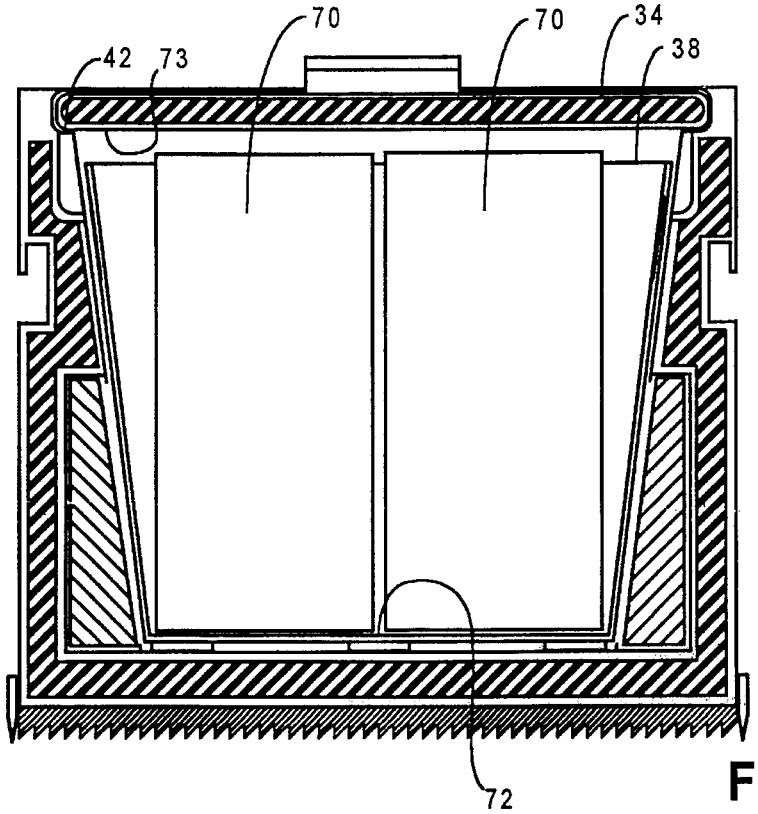
FIG. 7 is a cross sectional view similar to that in FIG. 6, except that it shows the container holding two standard sized grocery bags.

FIG. 7 is similar to FIG. 6, except that two standard sized grocery bags 70 are shown standing next to each other on the bottom of the basket. This illustrates that the dimension of the container and its basket are such that two standard grocery bags can stand upright next to each other and still fit within the container when it is closed. Although exact dimension may vary, many grocery bags, when unfolded and opened to their full size, have dimensions of approximately fourteen to sixteen inches in height, ten and one half inches in length, and six and one half inches in width. This is the size, within approximately an inch in each dimension, which we mean in this patent application and the claims that follow when we refer to a standard grocery bag. In order to enable two standard grocery bags to stand next to each other as shown in FIG. 7, the bottom interior surface 72 of the basket 38 should be approximately ten and one half inches by thirteen inches, and the distance between that bottom interior surface 72 and the bottom surface 73 of the lid 34, when that lid is resting on the shelf 42 should be a little over fourteen inches, such as fourteen and a quarter to sixteen inches. In other embodiments of the invention, the basket and insulated body could be dimensioned to fit grocery bags of other than the standard size.

It should be understood that the basket 38 or the insulated body 22 can be used either to carry groceries or other article contained in bags, or to carry groceries or articles which have been placed in directly, without the use of a bag to contain them.

Figure 8:
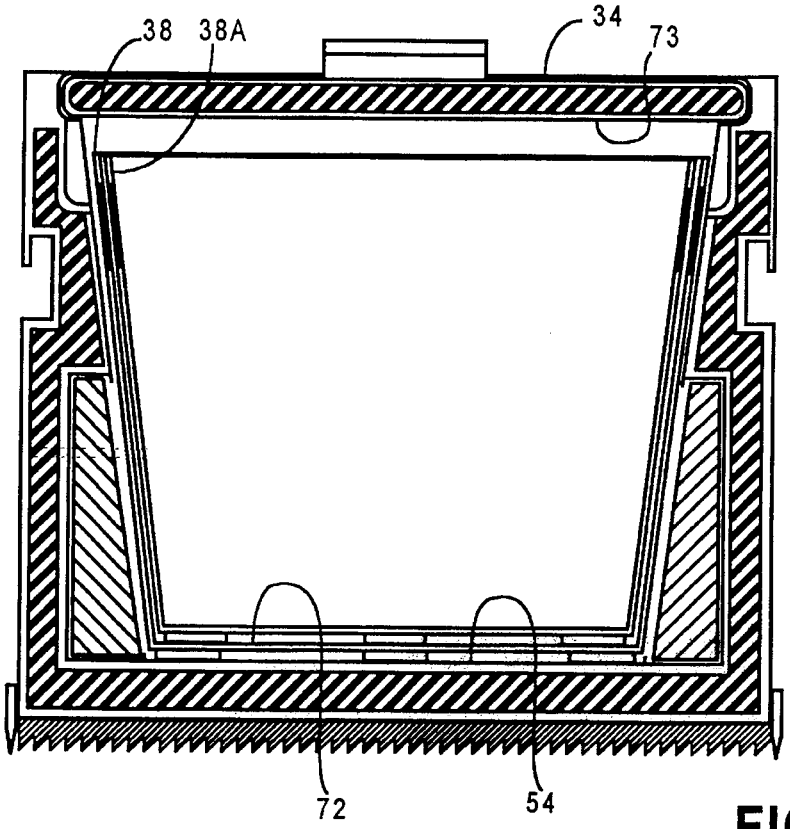
FIG. 8 is a cross sectional view similar to that in FIG. 6, except that two baskets are contained within the main insulating body rather than one.

FIG. 8 is also similar to FIG. 6, except than it shows two baskets 38 and 38A stacked within each other inside of the closed container 20. The inner basket 38A is slightly smaller to let it fit within the basket 38 and rest on the bottom upper surface 72 of basket 38. The inner basket is marked by a different color or other indicator, so the user of the container can quickly tell which basket is intended to fit inside the other. Having more than one such basket provides an extra container which can be used to hold groceries and other items. Yet the extra basket 38A takes up virtually no extra space when it is not being used, since it stores inside the other basket 38. In some embodiments of the invention the height of the insulating body is high enough that two full standard grocery bags can fit standing next to each other within the two baskets 38 and 38A even when the lid 34 is shut.

In certain embodiments of the present invention, supermarkets and other stores keep an inventory of removable baskets, such as the baskets 38 and/or 38A, and place groceries which have been purchased in such baskets, and then either have their employees or their customers replace the empty baskets in the customer's container 20 with the basket containing the groceries just purchased. When this is done the empty basket taken from the customer's car is then placed in the store's inventory for use by another customer. In some such embodiments, the baskets into which groceries have been placed can be placed on a conveyor belt or other conveyance to carry them from the check out counter to the parking lot from where they can be placed into the container 20 located in the customer's car. In such a case the store might actually own all of the containers 20 and their associated baskets 38 and lend or rent them to customers, or the customer's might have to purchase the containers 20 and agree to exchange his or her baskets 38 each time the store places a new basket into his or her container.

Figure 9:
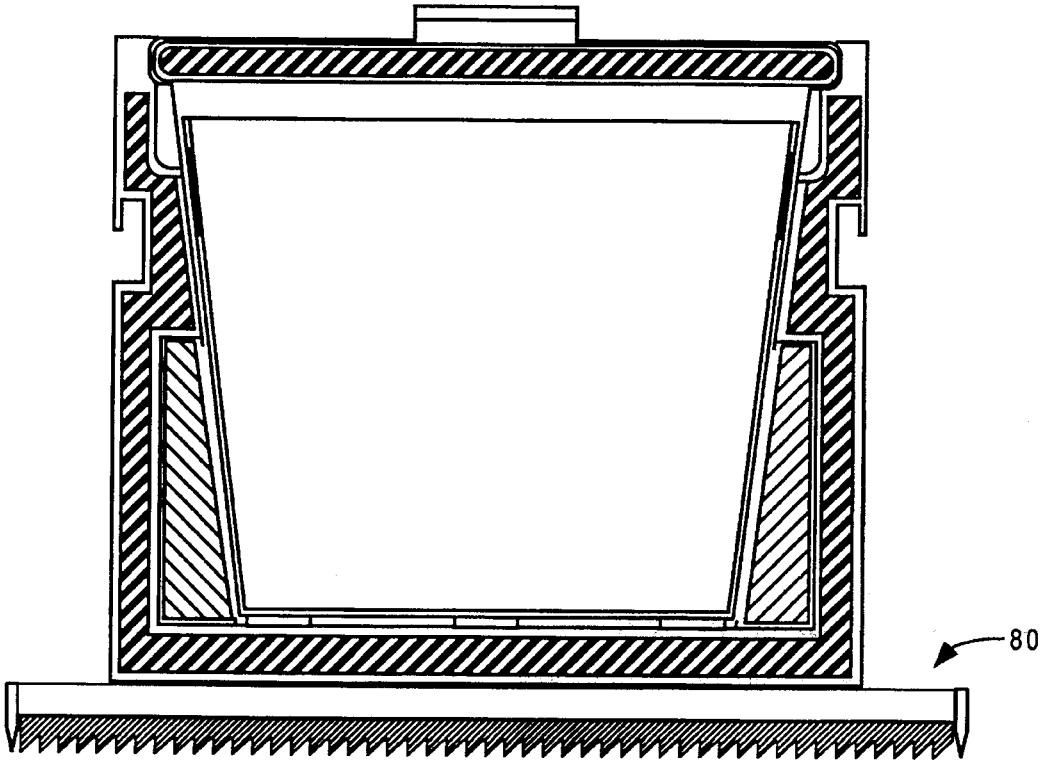
FIG. 9 is a cross sectional view of an alternate embodiment of the invention which is identical to the embodiment shown in cross section in FIG. 6, except that the bottom of the container has been widened to provide extra stability.

FIG. 9 is identical to FIG. 6, except that it shows an alternate embodiment of the invention which differs from that shown in the other figures by the fact that it has an elongated and widened bottom 80 placed on it which provides extra stability. The bottom 80 makes the bottom of the container wider than its top, decreasing the chance that the container will tip over. This can be useful in automotive vehicles, since such vehicles are often taking turns that will tend to tip containers over.

It should be understood that the forgoing descriptions and drawings are given merely to explain and illustrate the invention and that the invention is not to be limited thereto, except in so far as the interpretation of the appended claims are so limited. Those skilled in the art who have the disclosure before them will be able to make modifications and variations therein without departing from the scope of the invention.

For example, it should be understood that the container of the present invention could be constructed without cooler packs or without special indentations in the interior side walls of the insulated body of the container for cooler packs. Such a device could still provide insulation to groceries which were cold, since the main body and lid of the container are both insulated.

It should also be understood that an embodiment of the invention could be made which had multiple internal compartments, each of which was big enough to hold at least one upright standard grocery bag full of groceries and narrow enough to prevent that bag from falling all the way over on its side. Preferably such internal compartments would be only wide enough for one or two standard grocery bag.

It should also be understood that the container of the present invention could be made of different materials than those described above. For example the body and lid of the cooler could be made of virtually any materials used in other types of insulated containers.

It should be understood that in alternate embodiments of the invention different types of handles could be used on the insulated body of the container as well as on the removable basket. For example, alternate embodiments of the invention will use a handle that is rotatably mounted on opposite sides of the basket. Such a handle could selectively be folded down even with the topmost edge of the basket or extend up over the center of the basket, enabling the basket to be held by one hand. It should also be understood that more than two baskets could be stacked in the interior of the insulated body.

It should also be obvious that the insulated body of the container could be shaped differently and decorated differently than shown in the drawings above without departing from the invention.

Figure 10:
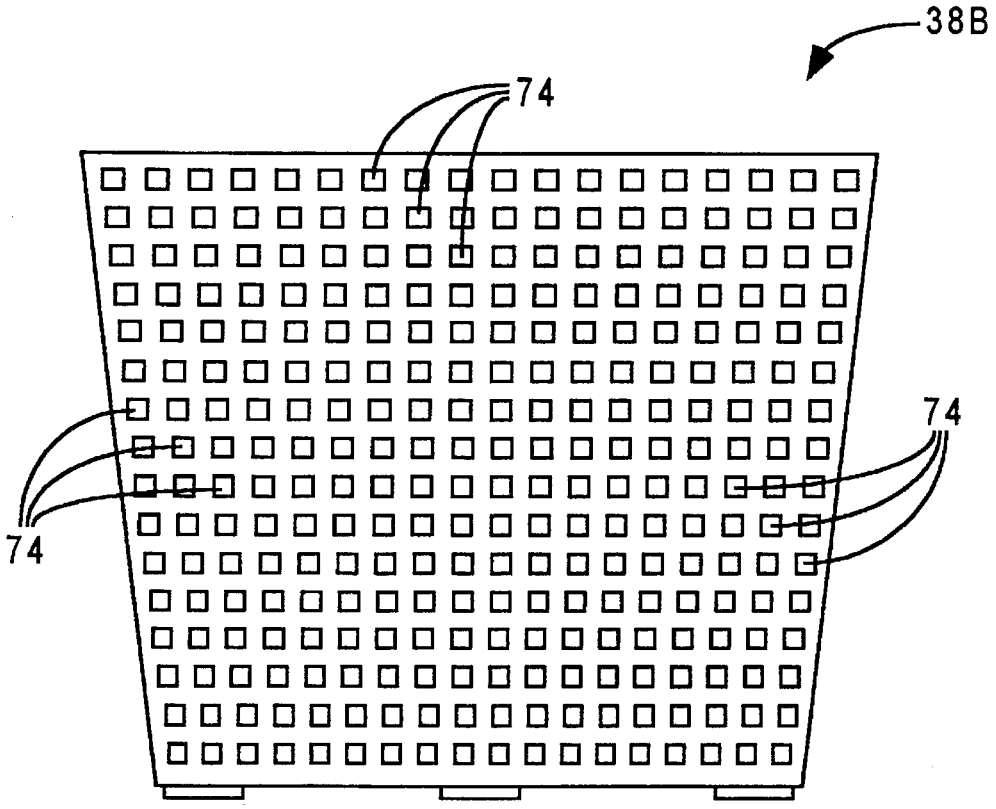
FIG. 10 is a side view of a basket which can be used in other embodiments of the invention.

In other embodiments of the invention the removable basket could contain perforations or holes (which are referred to as openings in several of the claims) in its surface to allow cool air from cooler packs to more easily circulate around the contents of the basket. This is illustrated in FIG. 10, which show a basket 38B having a plurality of holes 74 in its surfaces. In other embodiments of the invention the ridge shaped protrusions 53 shown in the figures on the bottom of the basket could be replaced with plastic knobs.

What I claim is:

1. A container for holding and carrying objects and for enabling objects placed within it to better maintain their temperature, said container comprising:

an insulated body having a first cavity and an opening to that cavity which points upward when said container is in an upright position;

a movable lid which can be positioned to fit across said opening and to close said cavity;

two removable baskets which are shaped and sized, so that one of them fits within the other, and so that when said one of them is fitted within the other they can both be inserted through said opening and fitted within said first cavity when said lid is positioned to close said cavity, wherein said baskets are:

shaped to generally fit against the interior walls of said insulated body which form said first cavity;

have sides which extend in a direction generally perpendicular to said insulating body's opening when said basket is positioned in said insulating body, and which are tapered, so that the basket is narrower at its bottom, which is positioned further away from said opening, than it is at its top, which is nearer said opening, when said basket is positioned in said cavity.

2. A container for holding and carrying objects and for enabling objects placed within it to better maintain their temperature, said container comprising:

a rigid insulated body having a first cavity and an opening to that cavity which points upward when said container is in an upright position, said body having interior walls which form walls of said first cavity;

a movable lid which can be positioned to fit across said opening and to close said cavity, said lid having a bottom wall which forms an upper wall for said first cavity;

means for holding at least one thermal pack, each of which is a container for holding means for heating or cooling, in place against at least one wall of said first cavity, to create a thermal cavity defined by the walls of said first cavity and said at least one thermal pack held against those walls, which thermal cavity can have its temperature heated or cooled by said thermal pack;

a removable basket which is shaped and sized to fit through said opening and to fit within said thermal cavity when said lid is positioned to close said thermal cavity, said basket being shaped to substantially but loosely fill said thermal cavity, so said basket can be easily removed from said insulated body, said basket having an interior that forms a second cavity substantially as large as said thermal cavity when said basket is placed in said insulated body; and wherein:

said basket has walls which are generally parallel to the interior walls of said insulating body when said basket is inserted in said thermal cavity; and said container includes means for spacing at least one of said basket's walls from the generally parallel interior wall of said insulating body when said basket is inserted in said thermal cavity; and said spacing means are formed by protrusions which stick out from the bottom of the basket.

3. A container as in claim 2 wherein said basket's walls include openings to allow air whose temperature has been changed by said thermal pack to pass through said basket walls.

4. A container as in claim 2 further including at least one thermal pack.

5. A container as in claim 4 wherein said at least one thermal pack is a cooler pack.

6. A container for holding and carrying objects and for enabling objects placed within it to better maintain their temperature, said container comprising:

an insulated body having a first cavity and an opening to that cavity which points upward when said container is in an upright position;

a movable lid which can be positioned to fit across said opening and to close said cavity;

a removable basket which is shaped and sized to fit through said opening and to fit within said first cavity when said lid is positioned to close said cavity;

wherein said insulating body has a bottom wall, the exterior surface of which is intended to lie on a flat surface said insulating body is placed upon when it is in the upright position and the exterior surface of said bottom wall contains grabbing means which are designed to decrease the likelihood that said bottom surface would slip relative to the surface it is placed upon, which grabbing means include treads.

7. A container as in claim 6 wherein said grabbing means further includes teeth located around the edge of said exterior surface of said bottom wall, said teeth being made of a more rigid material than said tread.

8. A container as in claim 6:

wherein said first cavity has walls;

further including means for holding at least one thermal pack, each of which is a container for holding means for heating or cooling, in place against at least one wall of said first cavity; and wherein said basket's walls include openings to allow air whose temperature has been changed by said thermal pack to pass through said basket walls.

9. A container for holding and carrying objects and for enabling objects placed within it to better maintain their temperature, said container comprising:

an insulated body having a first cavity and an opening to that cavity which points upward when said container is in an upright position;

a movable lid which can be positioned to fit across said opening and to close said cavity;

a removable basket which is shaped and sized to fit through said opening and to fit within said first cavity when said lid is positioned to close said cavity;

wherein said insulating body has a bottom wall, the exterior surface of which is intended to lie on a flat surface said insulating body is placed upon when it is in the upright position and the exterior surface of said bottom wall contains grabbing means which are designed to decrease the likelihood that said bottom surface would slip relative to the surface it is placed upon, which grabbing means include teeth which are designed to stick into and grab carpeting material.

10. A container for holding and carrying objects and for enabling objects placed within it to better maintain their temperature, said container comprising:

an insulated body having a first cavity and an opening to that cavity which points upward when said container is in an upright position;

a movable lid which can be positioned to fit across said opening and to close said cavity;

a removable basket which is shaped and sized to fit through said opening and to fit within said first cavity when said lid is positioned to close said cavity;

wherein:

said insulating body has side walls which extend upward when said insulating body is in an upright position, and a bottom wall, the bottom exterior surface of which lies horizontally and faces downward when said insulating body is in an upright position, and a horizontal cross section of said insulating body is wider at said bottom exterior surface than it is in at least the upper half of the upward extent of the insulating body's side walls, so as to decrease the likelihood that said container will tip over.

11. A container as in claim 10;

wherein said first cavity has walls;

further including means for holding at least one thermal pack, each of which is a container for holding means for heating or cooling, in place against at least one wall of said first cavity; and wherein said basket's walls include openings to allow air whose temperature has been changed by said thermal pack to pass through said basket walls.

* * * * *